US008721262B1

(12) United States Patent
Kuropatov

(10) Patent No.: US 8,721,262 B1
(45) Date of Patent: May 13, 2014

(54) VERTICAL CENTRIFUGAL PUMP

(71) Applicant: Alexander Ivanovich Kuropatov, Arlington, VA (US)

(72) Inventor: Alexander Ivanovich Kuropatov, Arlington, VA (US)

( * ) Notice: Subject to any disclaimer, the term of this patent is extended or adjusted under 35 U.S.C. 154(b) by 0 days.

(21) Appl. No.: 14/052,990

(22) Filed: Nov. 11, 2013

(51) Int. Cl.
*F04D 1/00* (2006.01)
*F04D 29/44* (2006.01)

(52) U.S. Cl.
USPC ..... 415/87; 415/98; 415/184; 415/185; 415/191; 415/204; 415/208.1; 415/208.2; 416/179; 416/180; 416/182

(58) Field of Classification Search
USPC ..... 415/87, 98, 183, 184, 185, 191, 203, 415/204, 208.1, 208.2; 416/179, 180, 182
See application file for complete search history.

(56) References Cited

U.S. PATENT DOCUMENTS

| | | | | | |
|---|---|---|---|---|---|
| 3,457,869 | A | * | 7/1969 | Ralph | 415/98 |
| 3,671,138 | A | * | 6/1972 | Ball | 415/111 |
| 3,817,653 | A | * | 6/1974 | Onal | 415/74 |
| 3,973,871 | A | * | 8/1976 | Hance | 415/198.1 |
| 4,131,386 | A | * | 12/1978 | Mabe, Jr. | 415/98 |
| 4,360,314 | A | * | 11/1982 | Pennell | 415/208.1 |
| 4,563,124 | A | * | 1/1986 | Eskew | 415/98 |
| 4,704,861 | A | * | 11/1987 | Mowill | 415/98 |
| 4,722,149 | A | * | 2/1988 | Weaver et al. | 415/1 |
| 4,840,535 | A | * | 6/1989 | Skarstad | 415/168.2 |
| 6,004,094 | A | * | 12/1999 | Precetti | 415/112 |
| 6,048,168 | A | * | 4/2000 | Sabini | 415/111 |

FOREIGN PATENT DOCUMENTS

| | | | |
|---|---|---|---|
| CN | 102116311 | A | 7/2011 |
| FR | 1246860 | A | 11/1960 |
| RU | 106682 | U1 | 7/2011 |
| SU | 823654 | A | 4/1981 |

OTHER PUBLICATIONS

Kostin V. I., Kuropatov A. B. J vybore glavnyh zirkulyarnyh nasosov pervogo kontura perspektivnyh ustanovok s natrievym teplonositelem. et.< "Teploenergetika", izdatelstvo "Energiya"1978: pp. 3-6.

* cited by examiner

*Primary Examiner* — Igor Kershteyn
(74) *Attorney, Agent, or Firm* — Nadya Reingand; Yan B. Hankin

(57) ABSTRACT

A vertical centrifugal pump comprises a housing, impeller, annular guiding vanes, annular outlet with outer and inner casings, forming a collector with a pressure pipe, and flow channels to lower and upper rims. Channels to the lower rim pass through the center of the pump axis. Blades direct flow between pipes into the pressure pipe. Pipes are connected with the lower rim through the lower confuser with flat radial ribs, positioned with the inner part of the confuser from the pipes and the outer part from the inner casing to the lower rim. An annular baffle is implemented between the housing and outer casing, dividing the inlet to the rims. Channels to the upper rim are created between the two annular elements, connected by radial outer ribs with a thickened, streamlined form and mated with flat inner ribs, merged in the upper confuser similarly to the lower confuser.

12 Claims, 8 Drawing Sheets

B-B

C-C

G-G

VERTICAL CENTRIFUGAL PUMP

CROSS-REFERENCE TO RELATED APPLICATIONS

This patent application claims priority to, and incorporates fully by reference, Russian patent RU2012144923/06 (072244) filed Oct. 22, 2012.

FIELD OF THE INVENTION

This invention relates to pump engineering, and specifically to vertical centrifugal pumps with a dual inlet impeller, used in nuclear power plants with integral-type reactors where all heat exchanging equipment including the pumps are placed inside the reactor casing and its diametric dimensions significantly affect the diameter of the reactor casing.

BACKGROUND OF THE INVENTION

Pumps with dual inlet impellers have smaller outer diameter compared to single-inlet impeller pumps due to the higher rotational speed of the pump shaft, making them more preferable for placement inside the reactor casing. However, the addition of the second inlet flow to the impeller leads to a complication in the construction of the flow-routing part of the pump due to the mutual intersection of the exhaust (pressurized) flow with one of the two intake flows to the dual intake impeller. In turn, this leads to an increase in the outer diameter of the pump in order to provide the necessary flow rates for both the outlet and inlet with the aim of achieving maximum pump efficiency. Additionally, attaining high pump efficiency is prevented by inlets (leading to the wheel rim) competing for the same space used by the circular outlet. The rotating pressurized flow intersects the inlet flows at right angles on the diametric plain. The sharp right angle turn causes impact of the outlet flow against the inlet walls with formation of vortices, which create significant hydraulic resistance for the outlet flow between inlets. One part of the outlet flow continues to move between inlets, while the other part keeps rotating in the circular outlet, thereby reducing the pump efficiency.

The increased speed of the dual inlet impeller pump shaft and the reduction of the effective intake flow area due to interference between inlet and outlet flows result in greater relative speed of inlet flow at the point of impeller entry and thus to a greater drop in pressure at the impeller inlet, which lowers anti-cavitation properties and service life of the pump. In order to maintain continuous, cavitation-free pump operation it is necessary to increase the relative gas pressure in the reactor's gas chamber, but it is limited and shouldn't exceed 0.05 MPa due to the constraints of its casing strength based on practical limits for reactor size, quantity of metal used, and sealing assemblies design.

Furthermore, casting elements are used due to the complexity of constructing flowing parts of the dual inlet impeller, lowering the quality of pump manufacturing technologies, which leads to increased wall thickness in the flowing part, mass and size dimensions and higher pump manufacturing costs.

Using for the inlet flow only one annular area between the casing and outer sidewall leads to the mutual influence of profluent axial jets on one another, resulting in the appearance of vortices that penetrate the entrance to the impeller and decrease flow velocities. The large hydraulic resistance at the inlet flows due to the flow bending from the axial direction to a radial one, as well as the limited inlet flow section decrease the pump efficiency, anti-cavitation properties and service life. Besides the use of elements with geometric similarity in pump construction, this fails to achieve dynamic similarity on the operating rim of the impeller and therefore fails to balance the workload of the impeller rims.

High resource demands, required for the reactor as well as its equipment, serve primarily for the development of an improved pump design with dual inlet impeller, specifically of a more compact pump, with a minimum outer diameter that simultaneously accommodates the largest possible impeller diameter inside, working at a reduced rotational speed, and having increased anti-cavitation properties, service life and efficiency.

A known centrifugal pump (see, e.g., cert. of author, USSR No 823653 cl. F04D 29/42 from 23 Apr. 1981), comprising a casing with annular collector and a supply pipe, containing a dual inlet impeller and annular guiding vanes with blades that have internal cavities that form interblade diffusion channels. Corrugated ridges that limit the annular collector, the projections of which form longitudinal channels that report to the diffuser channels, are installed in the casing. The pump fluid is pumped along the supply pipe to the entrance at the lower rim of the impeller. At the same time, the fluid is supplied to the upper rim of the impeller along the internal cavities of the annular guide vane. Having increased the energy in the impeller, the fluid enters the annular collector and further on the discharge pipe via the interblade diffusion channels.

The following are the main disadvantages of this pump design:

The intersection of the inlet and outlet flows in the diametric plane of the pump mutually act upon each other and wedge the flat annular flow area between themselves, which leads to an increase in pump diameter in order to achieve an acceptable pump efficiency.

Inconsistency in geometric similarity of input to the upper and lower impeller rim, a much greater hydraulic resistance, and greater non-uniformity of the velocity field attributable to the upper rim significantly reduce its anti-cavitation properties and as a consequence, its service life.

Minimizing the pressure loss at the exit from the guide vanes, the pump achieves great pressure losses in the form of leaks along the air gaps, upper and lower, in the pump casing, as the gaps come under the pump pressure from the annular collector, which reduces the efficiency of the pump.

A known pump (see, e.g., French patent application No 1246860, cl. F04D1/00; F04D1/06, of Nov. 25, 1960), comprising a cylindrical housing, containing a dual inlet impeller, vane outlet from the pumping chamber, connected to the discharge collector through overflow channels, alternating with radial feed channels in the cross section of the pump.

The main disadvantages of the pump are the same as in the aforementioned design:

The intersection of the outlet and inlet flows in the cross section of the pump does not provide a minimum pump diameter.

Inconsistency in geometric similarity of input to the upper and lower impeller rim. Great hydraulic resistance and greater non-uniformity of the velocity field attributable to the upper rim, and additionally the negative effect of the rotating shaft on the velocity field upon entry to the upper rim significantly reduce its anti-cavitation properties and as a consequence, its service life.

The low efficiency of the pump is due to the large hydraulic resistance at the flow exit from the blade outlet into the overflow channels, positioned at a right angle, where vortices form and fill the outlet section.

The closest analog from prior art to the invention, chosen as a prototype, is the vertical centrifugal pump (see, e.g., article: Kostin V. I., Kuropatov A. I. On the choice of the main circulator pumps for the primary circuit of prospective installations with sodium coolant. Publisher "Energy" magazine "Thermal Engineering", Mar. 3, 1978, pp. 54-57, FIG. 2.), comprising a cylindrical housing, containing a dual inlet impeller with upper and lower rows of blades, annular guide vane, annular outlet with outer and inner casing forming the a collector in the lower part, which feeds into the discharge pipe, and channels to supply fluid to the lower and upper rows, that latter formed by the housing and outer casing. The fluid being pumped enters the impeller from the annulus formed by the housing and outer casing. At the same time, fluid is supplied to the upper rim through the upper inlet channel, positioned radially and uniformly around the circumference with a flow rotation of 180°, and to the lower rim through lower inlet channel that is geometrically similar to the upper inlet channel and rotated by 45° in order to reduce the influence of axial jet flows on each other. Further, the flows from the upper and lower rims combine into a single flow, which exits the impeller into the annular guide vane and from there into the annular outlet between the inner and outer casings. From the annular outlet, the rotating annular flow experiences a 90° downward bend and an impact against the inlet channel walls and passes to the lower rim between them into the collector, which is formed in the lower part by the inner and outer casing, and further into the discharge pipe connected to them.

The disadvantages of the described pump design are as follows:

Large pump diameter. As a result of the intersection in the center plane of the annular outlet's inlet channels with the lower rim it is impossible to achieve a minimized outer pump diameter. Clogging of the outlet's annular channels by the inlet channels to the lower rim requires a larger area for the outlet's flow section in order to achieve maximum efficiency, which leads to an increased pump diameter. Additionally, the location of the annular guide vane in the center impeller plane between the annular outlet and impeller is not effective and increases the outer diameter of the pump by the width of the annular guide vane. It should be added that the greatest effectiveness of radial-type annular guide vanes is achieved by extending the diffusion channels, leading to an even greater increased in its outer diameter.

Complexity of the pump's flow parts design. In view of the complex geometric form of the inlet channel profile in the pump, casting elements are used, which lower the production quality of the pump's flow parts due to the sinks that form in them that are subsequently refined in the manufacturing process. The use of casting increases thickness of the flow parts walls, size and mass dimensions and the cost of manufacturing the pump.

Low pump efficiency. An imperfection in diverting the flow after the annular guide vane along the passage between the inlet channels reduces the efficiency of the pump. After the guiding vane, the rotating annular pressure flow has a high peripheral speed and when crossing the center plane with inlet channels at 90° suffers significant hydraulic resistance from the impact against the sidewall of the inlet channel in the form of vortex formation, which crowd the section along the vertical passage down between inlet channels and significantly lower pump efficiency. In addition, lower pump efficiency also contributes to significant hydraulic resistance from the inlet to the upper rim due to crowding of the channel-shaped section that replicates the lower rim. The radially positioned inlet channels in the center plane of the pump that supply the lower rim have a significant hydraulic resistance when the flow turns from an axial direction to a radial one. All of this additional hydraulic resistance on the inlets to upper and lower rims is introduced for the sake of geometric similarity upstream from the annular space between the pump housing and the discharge pipe. During pump construction, the use of inlets in the form of separate radial current flows at the impeller entrance does not provide a good velocity field around the entire entrance section upon suction, which reduces its efficiency, anti-cavitation properties and service life.

Lower anti-cavitation properties and service life of the pump. The increased rotational speed of the pump shaft to the dual inlet impeller and the crowding of the section where flow is supplied to the impeller are due to the mutual influence of inlet and outlet channels on each other lead to an increase in the relative velocity of the flow at the inlet to the impeller and consequently to an even greater reduction in pressure on the impeller inlet, which reduces the anti-cavitation properties and service life of the pump. To maintain continuous and cavitation-free operation it is necessary to increase the excess gas pressure in the reactor cavity, which leads to increased stress on the solid housing of the reactor and reduces its service life.

Problems with flow inlets to the impeller. In pump construction, when implementing geometric similarity in the inlet flow to the upper and lower impeller rims, the upper impeller rim is in the worst operating conditions due to the negative effect of the rotating shaft surface on the incoming radial-axial flow. The rotating shaft curls the incoming flow to the upper impeller rim and introduces additional irregularity to the velocity field with the formation of vortices on the inlet rim, which increases the relative velocity of the flow upon impeller suction and reduces its anti-cavitation properties. Furthermore, the upper impeller rim is in the worst operating conditions in relation to the lower rim because the smaller hydrostatic lift of the amount of geometrical differences between markers of the upper and lower rims. As a result of the aforementioned, in addition to the implementation of geometric similarity the dynamic conditions of the rim's velocity field are varied due to the lack of influence of the rotating shaft on the flow to the lower rim, which puts the lower rim in the best conditions for anti-cavitation properties. Rim operation is far from balanced and demands further improvement to pump design. Additionally, the pump uses one annular section between the housing and outer casing of the pump as an axial inlet to the upper and lower rim. In order to reduce the influence of the current of radial inlet flows on one another, the pump utilizes a turn of the upper inlet channels of 45° in relation to the lower channels. However, exclusion of the influence of axial flows on one another through the sides is not achieved, which leads to vortex formation, which extend deep into the pump impeller and distort the velocity field at the impeller inlet.

SUMMARY OF THE INVENTION

A vertical centrifugal pump comprises a cylindrical housing 1, which contains a dual inlet impeller 2 with upper and lower bladed rims 3 and 4, annular guiding vanes 5, annular outlet 6 with outer and inner casings 7 and 8, forming in the lower part a collector 9, connected to the pressure pipes 10, and channels 11 and 12 for the inlet of fluids to the lower and upper rims 4 and 3, the latter being formed by the housing 1 and the outer casing 7. The annular guiding vanes 5 positioned between the annular outlet 6 and collector 9, between the outer and inner casings 7 and 8, in the lower part having the form of two elliptical bottoms 13 and 14 on the outside and inside, respectively, positioned concentrically along the axis of the pump. Fluid inlet channels 11 to the lower rim 4 are implemented in the form of pipes 15 radially and uniformly positioned in the collector 9 around the pressure pipe 10, whose axes are inclined away from the axial direction and pass through the center 16 of the elliptical, concentric bottoms 13 and 14. From the guide vanes 5 to the pipes 15 and from the inner casing 8 to the outer casing 7 are positioned blades 17 with curved surfaces, forming with the aforementioned elements pocket-cavities 18 with radial outlet flow between pipes 15 in the pressure pipe 10. At the same time, a necessary, effective passage section between the pipes 15 is attained due to the increased radius of the outer elliptical bottom 13, resulting from an uninterrupted current flow along the blades 17 with curved surfaces of specified radius of curvature. Pipes 15 are connected to the cavity of the inner casing 8, which is hydraulically connected to the lower rim 4 through the lower annular radial-axial confuser 19 with flat ribs 20, radially positioned between the pipes 15. The lower annular radial-axial confuser 19 is positioned with its inner part's 21 profile from the point of intersection 22 of internals forming pipe 15, the inner parts 21 of the profile and inner bottom 14, while the outer portion 23 is located on the horizontal plane, from the inner casing 8 with a smooth turn from them in the axial direction to the lower blade row 4. Between the housing 1 and the outer casing 7 is a annular baffle 24 in the form of corrugated casing 25 with minimal gap 26 on the upper end relative to the outer casing 7, affixed to the housing 1 using radial ribs 27 and 28 on the upper and lower ends, projections 29 across from the pipes 15 form the longitudinal inlet flow channels 30 to the lower rim 4 together with the inner annular inlet 11 between the corrugated casing 25 and the pressure pipe 10. At the same time, adjacent depressions 31 together form the outer annular inlet 12 on the upper rim 3 between the housing 1 and corrugated casing 25, the lower end 32 which is located between the lowest point 33 of pipes 15.

Further, the inlet flow channels to the upper rim 3 are located between two annular elements 34 and 35, upper and low, respectively, with horizontal planes facing each other from the side of the outer diameter, interconnected by radial outer ribs 36 with a thickened, streamlined form and then connected to them by flat inner ribs 37, together forming radial sectors 38 in the cross section of the pump, merging into the upper annular radial-axial confuser 39 along the inner diameter 40 of the lower and upper annular elements 34 and 35, equal to the diameter of location at the point of intersection 22 of internals forming pipe 15, inner parts 21 of the profile of the lower confuser 19 and the inner bottom 14, with flat radial ribs 41, which are a continuation of the flat inner ribs 37, having a smooth turn from the horizontal to the axial direction, which is positioned up to the upper rim 3 blades similar to the lower confuser 19.

In addition, the annular baffle 24 may be implemented as a casing 42 with a flange 43 along the inner diameter on its upper rim and installed with a minimal mounting gap 44 between the flange 43 and the outer casing 7, mounted on the housing 1 using radial ribs 45 and 46 on its upper and lower ends, the lower end 47 that is positioned below the lowest point 33 of the pipe 15, which divides the annual axial inlet between the housing 1 and the pressure pipe 10 on the inner annular inlet 11 to the lower rim 4 and the outer inlet 12 to the upper rim 3.

The inner part 48 of the upper annular radial-axial confuser 39 with flat radial rips 41 may be removable at the maximum possible diameter, for example, connected to the lower radial bearing 49 and affixed to it at its end. For the lower confuser 19 the inner and outer parts 21 and 23, joined with the ribs 20 as a whole, can be dismantled and mounted the flange on the inner casing 8. Thus, the outer part 50 of the upper confuser 39 may be similarly implemented as a removable flange, forming the outer part 50 of the confuser 39 profile.

Further, the upper annular radial-axial confuser 39 with inner and outer parts 51 and 52 with flat radial ribs 37, as a single assembly, may be dismantled and fixed on the flange of the lower annular element 34 along its inner diameter. Between the radially mounted ribs 53, which are extensions of the ribs 20 of the peripheral zone of the lower confuser 19, positioned and mounted on the blades 54 of a constant thickness along the cross-section, with curved surface, concentrically located between each other along the pump axis, uniformly along the meridian section with the width of its projections onto the horizontal plane equal to the projection of the pipe 15 diameter onto the same plane, while from the inlet sides of the edges the blades have a smooth decrease in thickness in the direction of the edge. Upper and lower annular radial-axial confusers 39 and 19 with flat radially-mounted ribs 37, 41, and 20 are geometrically similar parts within the limits of the diameter of the intersection point 22 of internals forming pipe 15, the inner part 21 of the lower confuser 19 profile and the inner bottom 14, which also contains blades 55 and 56 with curved surfaces, concentric to the inner parts 48, 51, and 21 of upper and lower confusers accordingly, mounted on the ribs 37, 41, and 20 respectively, uniformly along the meridian section of the confuser, turning the flow from a horizontal direction to an axial one toward the rim, while from the side of the outlet edges the blades 55 and 56 have a smooth decrease in thickness towards the edge. Moreover, the blades of the upper confuser 39 from the inlet side have just as smooth a decrease in thickness toward the edge. Radial flat ribs 37 and 41 of the upper annular radial-axial confuser 39 are unrolled by half a pitch between them relative to the radial flat ribs 20 and 53 of the lower confuser 19. Radial flat ribs 37, 41, and 20 may have a smooth decrease in thickness in the direction of the impeller rim. Pipes 15 at the inlet may also have confusers 57.

Between the pipes 15 additional blades 58 may be installed, similar to blades 17, leaning on the pipes 15. All blades 17 and 58 between the guiding vanes 5 and pipes 15 may have a constant thickness, and from the side of the incoming flow have a streamlined form with an understated thickness toward the outlet edge. Pipes 15 may have a cylindrical or conical form similar to confusers. The lower part of the annular baffle 24 in the form of casings 25 and 42 can have an understated wall thickness along the whole perimeter.

DETAILED DESCRIPTION OF THE PREFERRED EMBODIMENT

Figure 1:
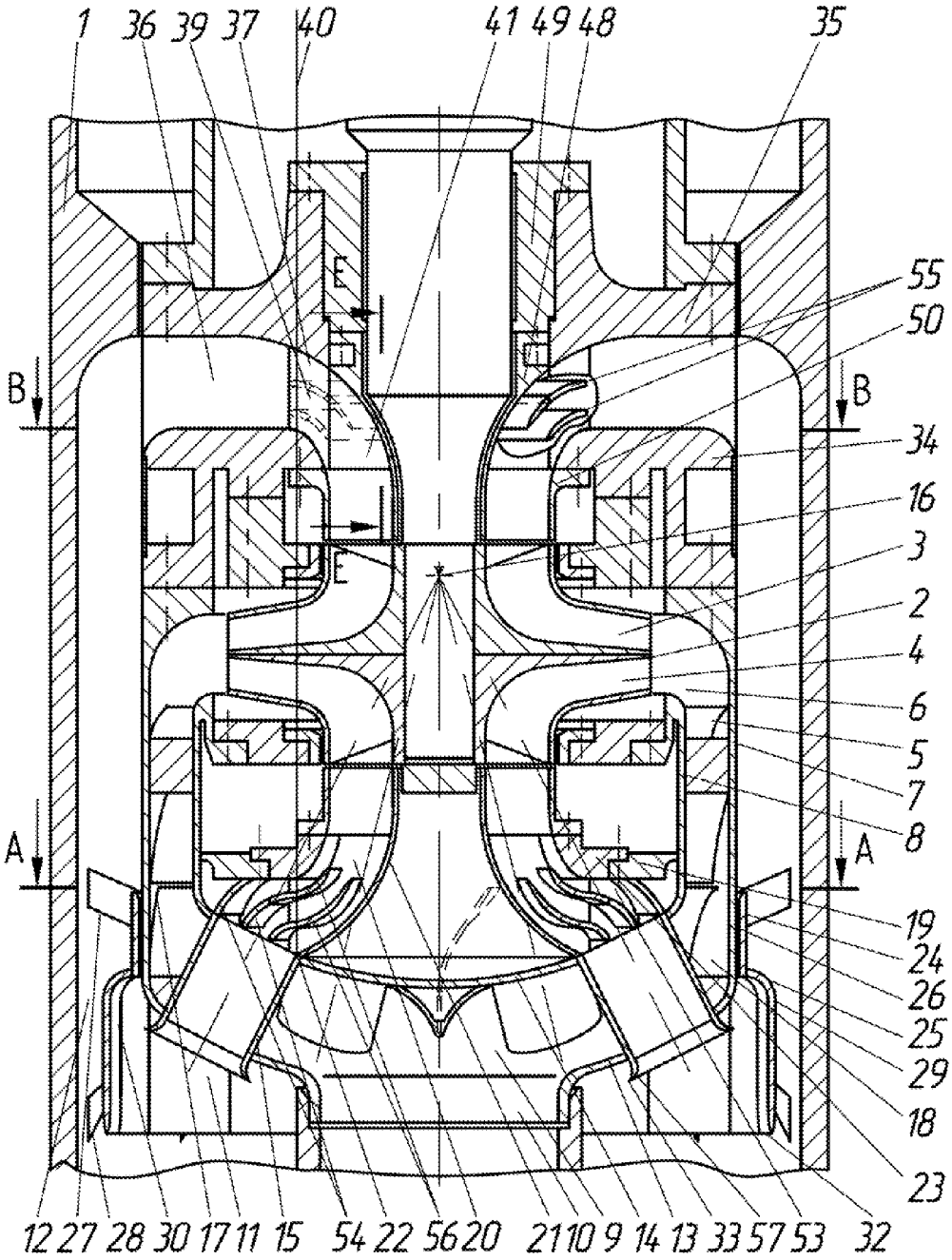
FIG. 1 shows a pump according to the current invention, longitudinal cross-section.
Figure 2:
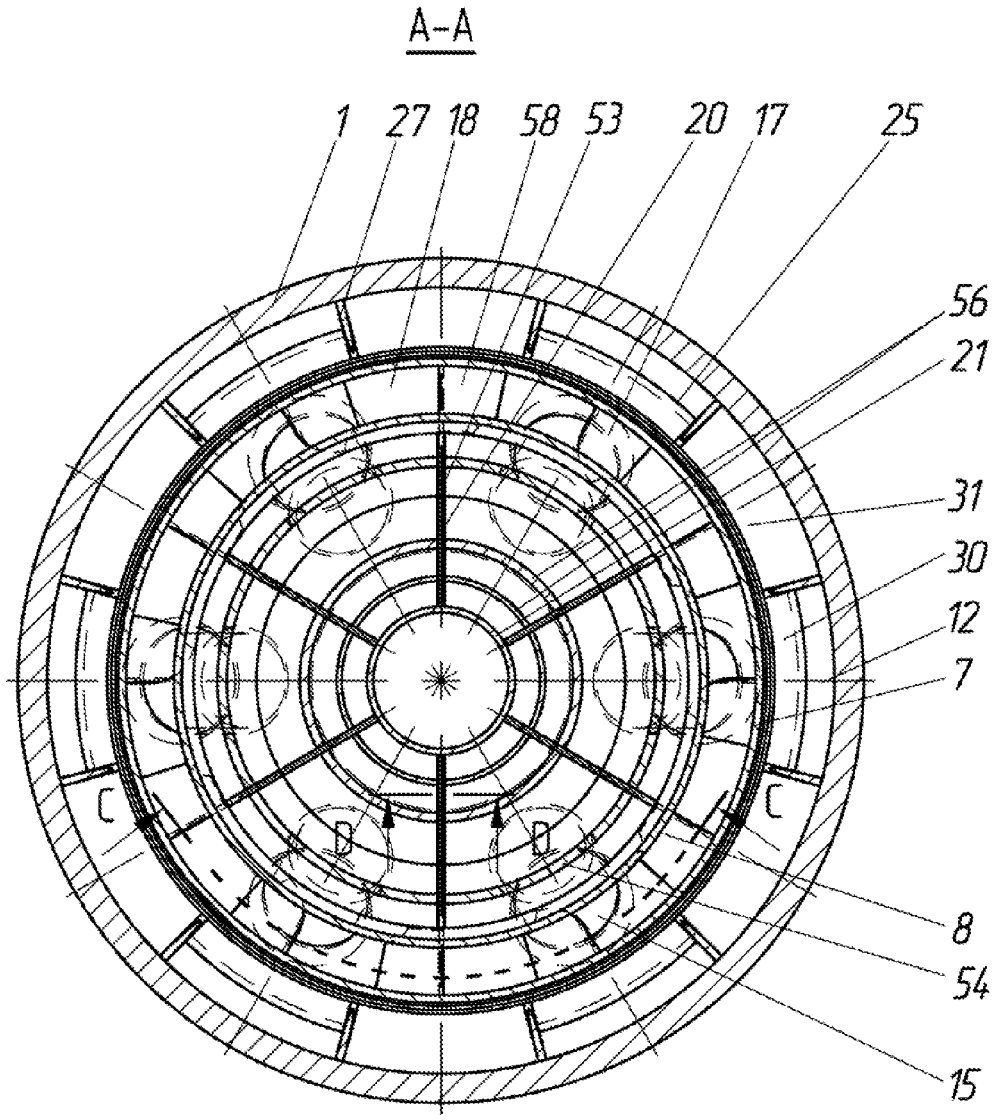
FIG. 2 shows cross-section A-A of FIG. 1.
Figure 3:
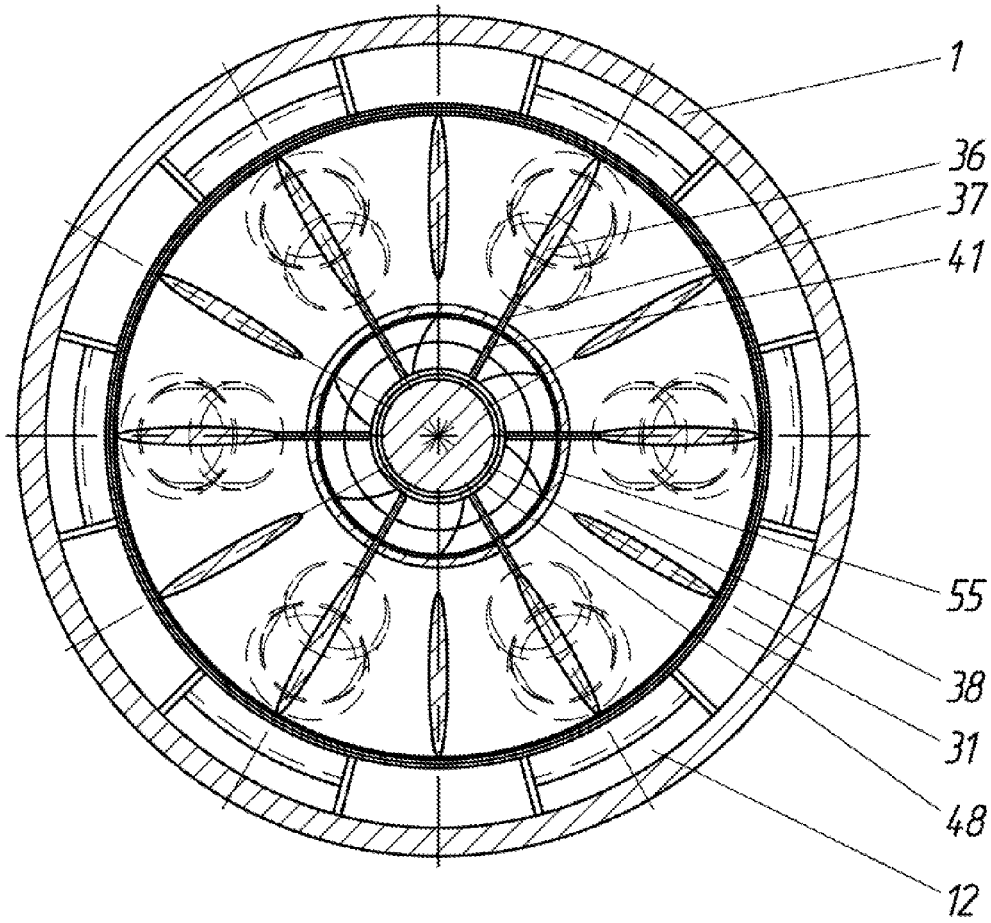
FIG. 3 shows cross-section B-B on FIG. 1.
Figure 4:
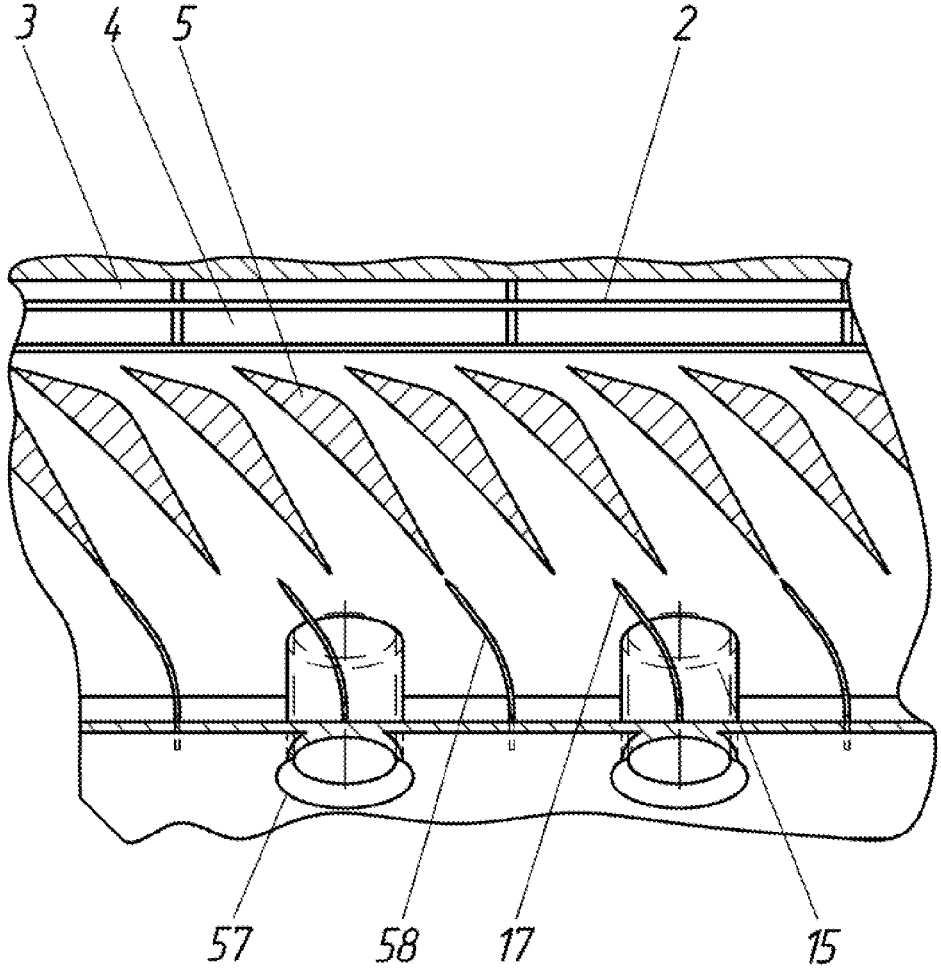
FIG. 4 shows cross-section C-C on FIG. 2, cylindrical unraveling.
Figure 5:
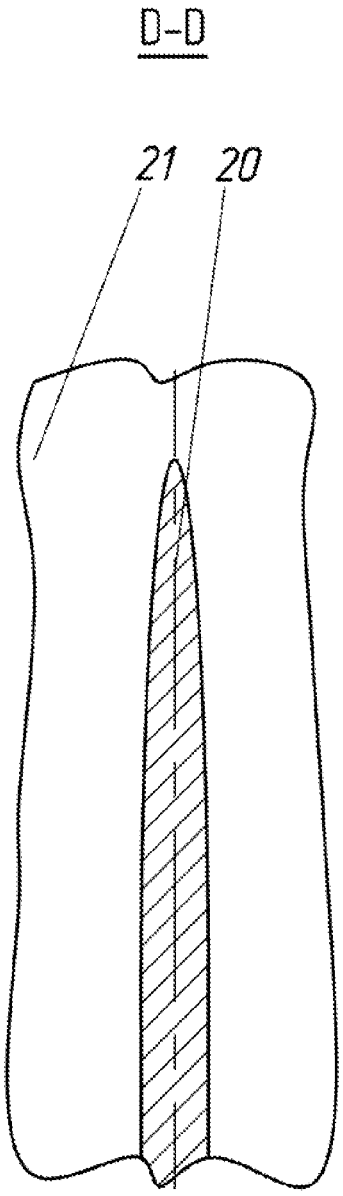
FIG. 5 shows cross-section D-D on FIG. 2 with enlarged scale.
Figure 6:
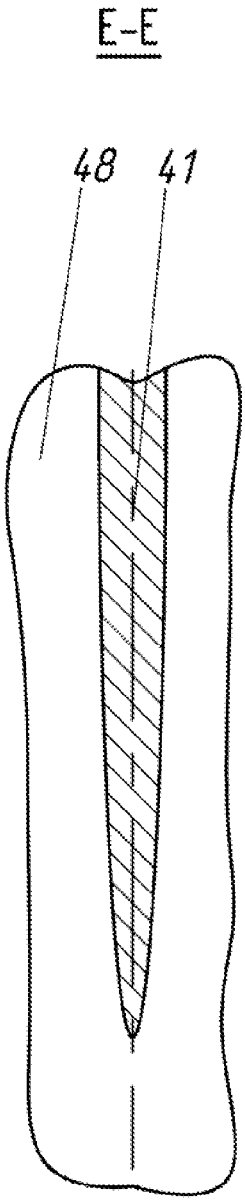
FIG. 6 shows cross-section E-E on FIG. 1 with enlarged scale.
Figure 9:
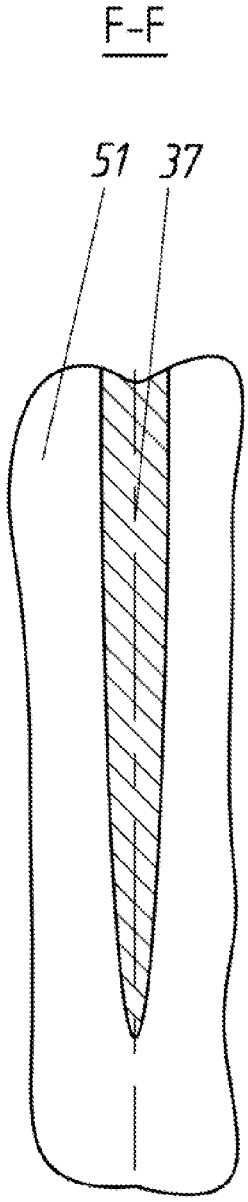
FIG. 9 shows cross-section F-F on FIG. 8 with enlarged scale.
Figure 7:
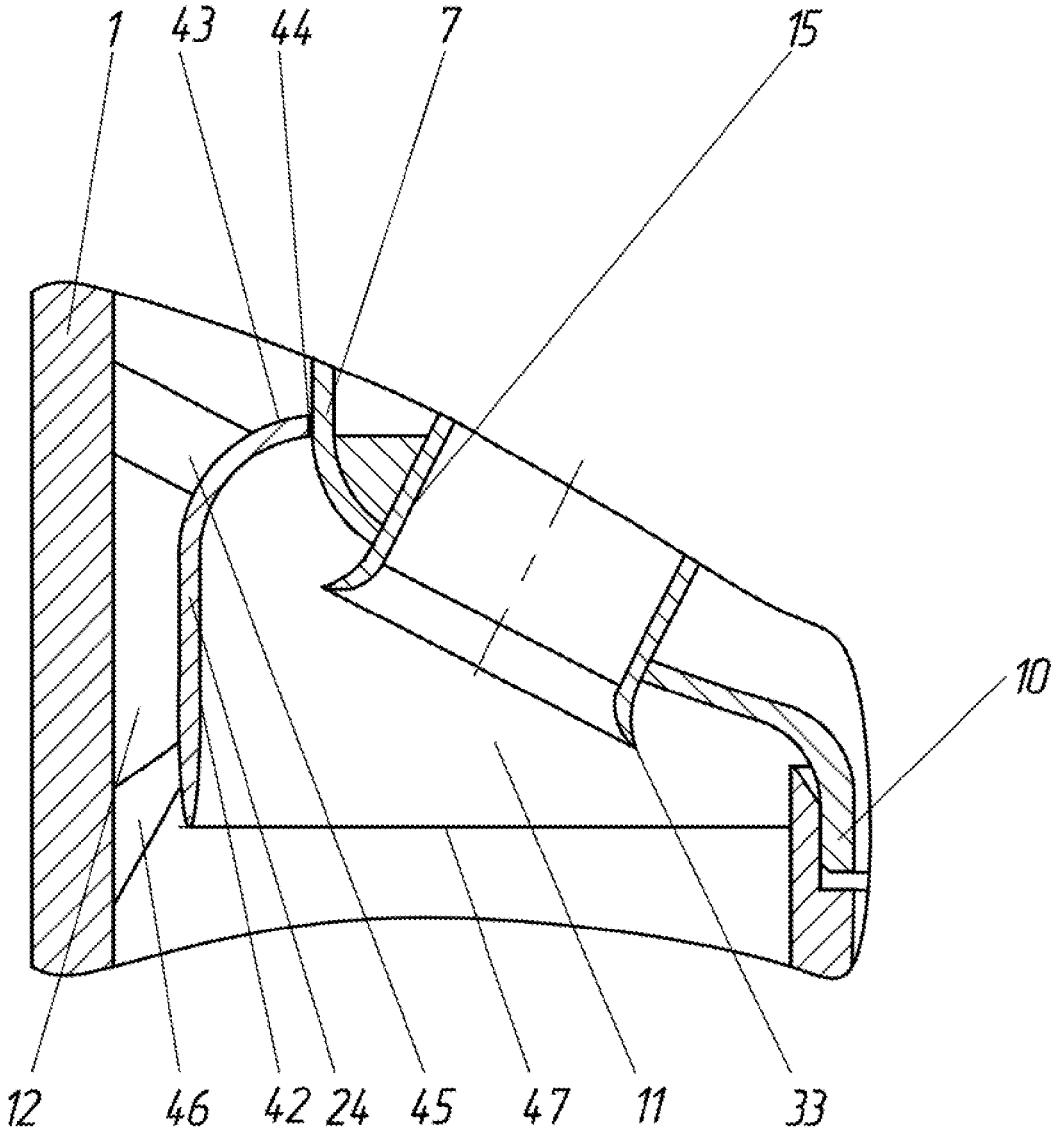
FIG. 7 shows the longitudinal cross-section of the pump, a preferred embodiment of the annular baffle with enlarged scale.
Figure 8:
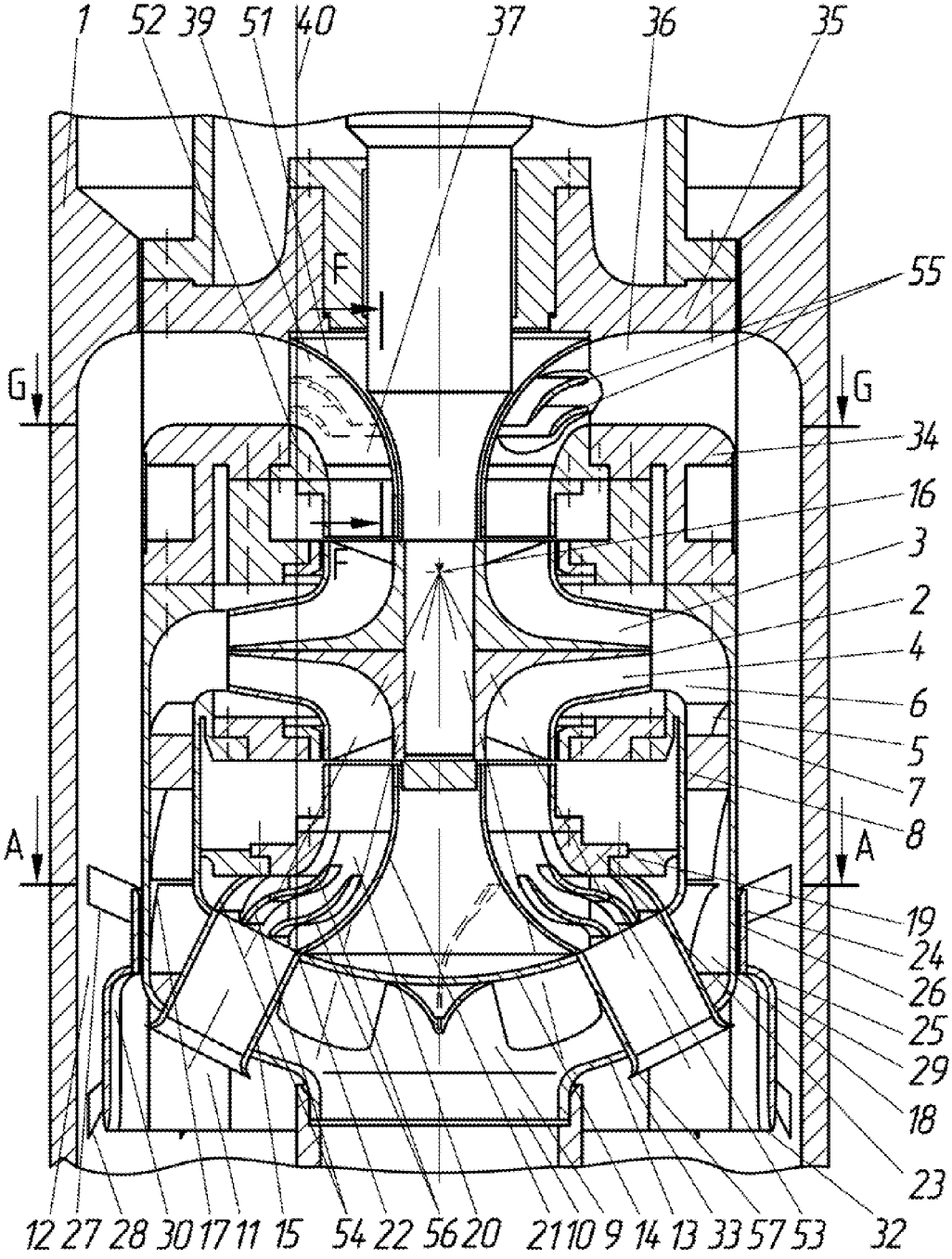
FIG. 8 shows the longitudinal cross-section of pump, a preferred embodiment of upper annular radial-axial confuser.
Figure 10:
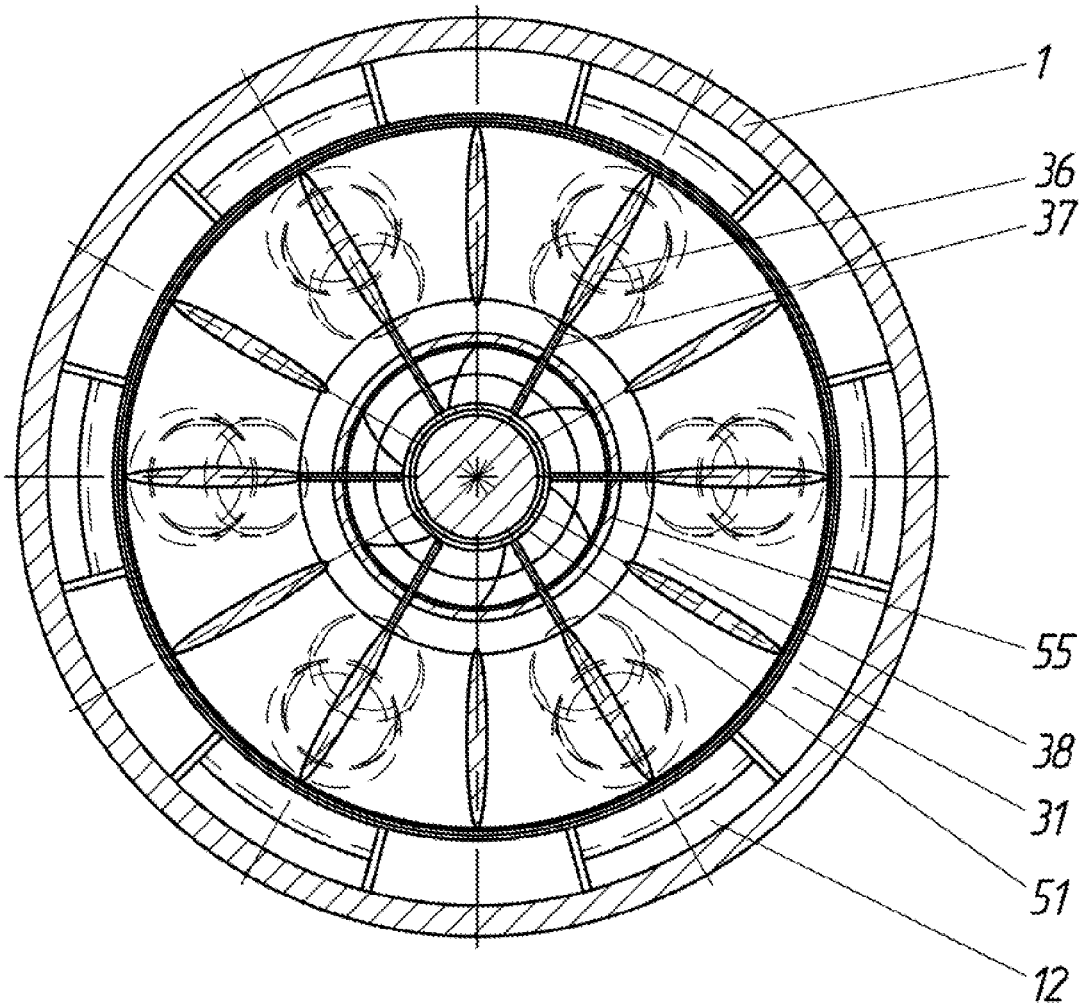
FIG. 10 shows cross-section G-G on FIG. 8.

The objectives of the claimed invention are as follows:

1. Reducing the outer diameter of the pump while accommodating within it an impeller with the largest possible diameter. Thus, the necessary and effective passage section of the outlet between the inlet channels to the lower rim is implemented not by increasing the outer diameter of the pump, which is ineffective, but by lengthening the pump, thereby increasing the surface area of the passage section between the inlet channels, which does not influence the outer diameter of the pump and is not critical for the pump due to its application in integral-type reactors.

2. Simplification of pump design, improvement in design technology and the quality of manufacturing technology, decreasing size and mass dimensions of the pump.

3. Increasing the efficient of the pump by reducing hydraulic resistance to the inlet flow to the upper and lower rims, as well as by improving the outlet flow after the annular guide vanes between the outlet flow channels to the lower rim.

4. Improving anti-cavitation properties and service life of the pump. Increases in anti-cavitation properties and service life of the pump depend on the pump impeller rotation speed. Lowering the impeller rotation speed increases it anti-cavitation properties and service life. This can be achieved if, in a pump of the same size as the prototype, a dual inlet impeller with a greater outer diameter than the prototype is installed, providing the same specified key features of the pump: flow and pressure at a reduced rate of impeller rotation. The relationship between the diameter of the pump impeller and the effect on it due to the pump shaft rotation speed while keeping the major parameters unchanged can be determined by the formula: $Di=C\times 1/n$, where Di=outer diameter of the pump impeller;

C=coefficient of proportionality, taking into account the change in pump pressure;

n=pump impeller rotational speed;

And if you introduce the parameter, Coe.=Di/Do, where

Coe.=parameter of effectiveness of impeller placement within the pump;

Di=outer diameter of the pump impeller;

Do=outer diameter of the pump;

this shows that the greater the value of this parameter, the greater the size of the impeller that can be installed in the pump and, consequently, the greater the reduction in impeller rotation speed, thereby increasing anti-cavitation properties and service life. To compare the efficiency of pump by the parameter Coe, you can conclude the following: for the prototype the parameter Coe≈0.47, therefore, the objective of the claimed invention is to create a more refined pump design with a Coe parameter greater than 0.47;

5. Improvement of the inlet flows and reduction of their effect on each other, reduction of the hydraulic resistance of inlets, reduction of the formation of vortices at the flow turns and even greater uniformity in velocity distribution along the flow, improvement of pump suction properties, elimination of the effect of the rotating shaft on the incoming radial-axial flow, implementation of geometric and dynamic similarities for upper and lower impeller inlets, even velocity field distribution at the working rims of the impeller, maximization of the workload balance of impeller rims.

A vertical centrifugal pump comprises a cylindrical body, containing a dual inlet impeller with upper and lower rows of blades, annular guide vanes, annular outlet with outer and inner casing, forming a collector below with a pressure pipe, and inlet flow channels to the lower and upper rims, annular guide vanes positioned between the annular outlet and collector, an outer and inner rim below implemented in the form of two elliptical, concentric heads, outer and inner, arranged along the pump axis, inlet flow channels to the lower rim in the form of pipes through the bottom, with their axis through the center of the bottom, from the guide vanes to the pipes, from the inner rim to the outer rim the blades a positioned with a curved surface, forming pocket cavities with radial outlet flow between pipes into the pressure pipe, with the possibility of uninterrupted current flow along the blades with a specified radius of curvature, while the pipes are connected with the lower rim through the lower annular radial-axial confuser with flat ribs, positioned radially between the pipes, the inner part of its profile running from the inside point of intersection forming the pipe, inner part of the profile and inner bottom, and the outer part positioned on the horizontal plane from the inner rim with a smooth turn from the rim in an axial direction to the lower blade rim, and between the housing and outer casing implement an annular baffle in the form of corrugated casing with minimal mounting gap on its upper end relative to the outer casing, mounted on the housing radial ribs along its upper and lower ends, projections opposite the pipes form longitudinal inlet flow channels on the lower rim together with inner annular inlet between the corrugated casing and pressure pipe, and adjacent cavities form together with the outer annular inlet on the upper rim between the housing and corrugated casing, the lower end of which is located below the lowest point of the pipe, and further inlet flow channels to the upper rim are implemented between two annular elements, lower and upper, with horizontal surfaces interconnected by radial outer ribs with thickened, streamlined form and then mated to flat inner ribs, together forming radial sectors in the cross section of the pump, merged into an upper annular radial-axial confuser along the inner diameter of the annular elements, equal to the diameter of the placement of the point of intersection of the inner part of the lower confuser profile and the inner bottom, with flat radial ribs, which are a continuation of the flat inner ribs, with smooth flow turn within them in the axial direction, which is placed before the upper bladed rim similarly to the lower confuser.

The annular baffle may be formed as a casing with a flange on the inner diameter of its upper end and installed with minimal clearance between the flange and the outer casing, mounted on the housing radial ribs, on its upper and lower ends, the lower end of which is located below the lowest point of the pipes, which divide the axial annular inlet between the housing and pressure pipe on the inside annular inlet to the lower rim and on the outside to the upper rim.

The inner part of the upper annular radial-axial confuser with flat radial ribs can be removable at the maximum possible diameter, for example, with a lower radial bearing and mounted to it on its end, while the lower confuser's inner and outer parts with flat radial ribs, as a single assembly, are disassembled and fixed to the flange on the inner casing, whereby the outer part of the upper confuser can be removable and in the form of a flange, forming the outer part of the upper confuser profile.

The upper annular radial-axial confuser with its inner and outer parts and flat radial ribs, may be formed as a single assembly and mounted on the flange of the lower annular element along its inside diameter.

Between the radially installed ribs of the outer part of the lower confuser, blades of a constant thickness are located and mounted along the section, with a curved surface, concentrically arranged between themselves along the pump axis, uniformly along the meridian section, with the thickness of projections onto the horizontal plane equal to the projection of the pipe diameter on the same plane, where from the side of the inlet edges the blades have a smooth decrease in thickness in the direction of the edge.

The upper and lower confusers with flat radially-mounted ribs, having geometrically similar parts, also have blades of a constant thickness along the section, with a curved surface, concentric to the inner part of the confuser, mounted on the ribs uniformly along the meridian section of the confuser, with the ability to turn the flow from a horizontal direction to an axial one towards the rim, while from the sides of the outlet edges the blades have a smooth decrease in thickness in the direction of the edge, and from the inlet flow side the blades of the upper confuser also have a smooth decrease in thickness in the direction of the edge.

The radial ribs of the upper confuser are rotated by a half pitch between them in relation to the radial flat ribs of the lower confuser.

Radial flat ribs have a smooth decrease in thickness in the direction of the impeller rim.

Pipes at the inlet may be equipped with confusers.

Between the pipes, additional blades can be installed similar to those leaning on the pipes.

All of the blades between the guiding vanes and pipes may be of a constant thickness, and from the incoming side of the flow are streamlined with an understated thickness to the front edge.

The lower part of the annular baffle may have walls of an understated thickness along the whole perimeter.

The Figures illustrate a vertical centrifugal pump comprising a cylindrical housing 1, which contains a dual inlet impeller 2 with upper and lower bladed rims 3 and 4, annular guiding vanes 5, annular outlet 6 with outer and inner casings 7 and 8, forming in the lower part a collector 9, connected to the pressure pipes 10, and channels 11 and 12 for the inlet of fluids to the lower and upper rims 4 and 3, the latter being formed by the housing 1 and the outer casing 7. The annular guiding vanes 5 positioned between the annular outlet 6 and collector 9, between the outer and inner casings 7 and 8, in the lower part having the form of two elliptical bottoms 13 and 14 on the outside and inside, respectively, positioned concentrically along the axis of the pump. Fluid inlet channels 11 to the lower rim 4 are implemented in the form of pipes 15 radially and uniformly positioned in the collector 9 around the pressure pipe 10, whose axes are inclined away from the axial direction and pass through the center 16 of the elliptical, concentric bottoms 13 and 14. From the guide vanes 5 to the pipes 15 and from the inner casing 8 to the outer casing 7 are positioned blades 17 with curved surfaces, forming with the aforementioned elements pocket-cavities 18 with radial outlet flow between pipes 15 in the pressure pipe 10. At the same time, a necessary, effective passage section between the pipes 15 is attained due to the increased radius of the outer elliptical bottom 13, resulting from an uninterrupted current flow along the blades 17 with curved surfaces of specified radius of curvature. Pipes 15 are connected to the cavity of the inner casing 8, which is hydraulically connected to the lower rim 4 through the lower annular radial-axial confuser 19 with flat ribs 20, radially positioned between the pipes 15. The lower annular radial-axial confuser 19 is positioned with its inner parts 21 profile from the point of intersection 22 of internals forming pipe 15, the inner parts 21 of the profile and inner bottom 14, while the outer portion 23 is located on the horizontal plane, from the inner casing 8 with a smooth turn from them in the axial direction to the lower blade row 4. Between the housing 1 and the outer casing 7 is a annular baffle 24 in the form of corrugated casing 25 with minimal gap 26 on the upper end relative to the outer casing 7, affixed to the housing 1 using radial ribs 27 and 28 on the upper and lower ends, projections 29 across from the pipes 15 form the longitudinal inlet flow channels 30 to the lower rim 4 together with the inner annular inlet 11 between the corrugated casing 25 and the pressure pipe 10. At the same time, adjacent depressions 31 together form the outer annular inlet 12 on the upper rim 3 between the housing 1 and corrugated casing 25, the lower end 32 which is located between the lowest point 33 of pipes 15.

Further, the inlet flow channels to the upper rim 3 are located between two annular elements 34 and 35, upper and low, respectively, with horizontal planes facing each other from the side of the outer diameter, interconnected by radial outer ribs 36 with a thickened, streamlined form and then connected to them by flat inner ribs 37, together forming radial sectors 38 in the cross section of the pump, merging into the upper annular radial-axial confuser 39 along the inner diameter 40 of the lower and upper annular elements 34 and 35, equal to the diameter of location at the point of intersection 22 of internals forming pipe 15, inner parts 21 of the profile of the lower confuser 19 and the inner bottom 14, with flat radial ribs 41, which are a continuation of the flat inner ribs 37, having a smooth turn from the horizontal to the axial direction, which is positioned up to the upper rim 3 blades similar to the lower confuser 19.

In addition, the annular baffle 24 may be implemented as a casing 42 with a flange 43 along the inner diameter on its upper rim and installed with a minimal mounting gap 44 between the flange 43 and the outer casing 7, mounted on the housing 1 using radial ribs 45 and 46 on its upper and lower ends, the lower end 47 that is positioned below the lowest point 33 of the pipe 15, which divides the annual axial inlet between the housing 1 and the pressure pipe 10 on the inner annular inlet 11 to the lower rim 4 and the outer inlet 12 to the upper rim 3.

The inner part 48 of the upper annular radial-axial confuser 39 with flat radial rips 41 may be removable at the maximum possible diameter, for example, connected to the lower radial bearing 49 and affixed to it at its end. For the lower confuser 19 the inner and outer parts 21 and 23, joined with the ribs 20 as a whole, can be dismantled and mounted the flange on the inner casing 8. Thus, the outer part 50 of the upper confuser 39 may be similarly implemented as a removable flange, forming the outer part 50 of the confuser 39 profile.

Further, the upper annular radial-axial confuser 39 with inner and outer parts 51 and 52 with flat radial ribs 37, as a single assembly, may be dismantled and fixed on the flange of the lower annular element 34 along its inner diameter. Between the radially mounted ribs 53, which are extensions of the ribs 20 of the peripheral zone of the lower confuser 19, positioned and mounted on the blades 54 of a constant thickness along the cross-section, with curved surface, concentrically located between each other along the pump axis, uniformly along the meridian section with the width of its projections onto the horizontal plane equal to the projection of the pipe 15 diameter onto the same plane, while from the inlet sides of the edges the blades have a smooth decrease in thickness in the direction of the edge. Upper and lower annular radial-axial confusers 39 and 19 with flat radially-mounted ribs 37, 41, and 20 are geometrically similar parts within the limits of the diameter of the intersection point 22 of internals forming pipe 15, the inner part 21 of the lower confuser 19 profile and the inner bottom 14, which also contains blades 55 and 56 with curved surfaces, concentric to the inner parts 48, 51, and 21 of upper and lower confusers accordingly, mounted on the ribs 37, 41, and 20 respectively, uniformly along the meridian section of the confuser, turning the flow from a horizontal direction to an axial one toward the rim, while from the side of the outlet edges the blades 55 and 56 have a smooth decrease in thickness towards the edge. Moreover, the blades of the upper confuser 39 from the inlet side have just as smooth a decrease in thickness toward the edge. Radial flat ribs 37 and 41 of the upper annular radial-axial confuser 39 are unrolled by half a pitch between them relative to the radial flat ribs 20 and 53 of the lower confuser 19. Radial flat ribs 37, 41, and 20 may have a smooth decrease in thickness in the direction of the impeller rim. Pipes 15 at the inlet may also have confusers 57.

Between the pipes 15 additional blades 58 may be installed, similar to blades 17, leaning on the pipes 15. All blades 17 and 58 between the guiding vanes 5 and pipes 15 may have a constant thickness, and from the side of the incoming flow have a streamlined form with an understated thickness toward the outlet edge. Pipes 15 may have a cylindrical or conical form similar to confusers. The lower part of the annular baffle 24 in the form of casings 25 and 42 can have an understated wall thickness along the whole perimeter.

The pump operates as follows. The fluid enters into the impeller 2 through channels 11 and 12 supplying fluid to the lower and upper rims 4 and 3. The annular baffle 24 in the form of corrugated casing 25 divides the axial inlet into the inner annular inlet 11 to the lower rim 4 jointly with longitudinals channels 30, and outer annular concentric inlet 12 to the upper rim 3 between housing 1 and corrugated casing 25 jointly with adjacent cavities 31. Fluid enters the lower rim 4 with a slight flow incline from the axial direction and through the pipes 15 to the cavity of the lower annular radial-axial confuser 19. Upon exiting the pipes 15 the flow, entering the peripheral zone of the lower confuser 19, smoothly and without vortex formation is rotated by the blades 54 in the horizontal direction gradually spreading in the interblade space between the flat radial ribs 53 and 20. Next the flow smoothly turns from the horizontal towards the axial direction using the blade 56, which act as extensions of blades 54, allowing a decrease in vortex formation during the rotation and evenly distributing velocities along the flow section at the inlet to the impeller's 2 lower rim 4. Moving axially between the radial ribs 20 the flows from the pipes 15 merge into one annular axial flow by gradually decreasing the thickness of ribs 20 in the direction of impeller 2 rim 4 and the correspondingly formed by the inner 21 and outer 23 profile parts, positioned up until the lower bladed rim 4. The annular baffle 24 can further reduce the effect of the axial flow streams on one another and vortex formation, going towards the impeller rim. The outer annular inlet 12 uniformly supplies the fluid around the whole perimeter to inlet flow channels to the upper rim 3, formed between the two annular elements 34 and 35, lower and upper, respectively. Then the flow turns 90° from the annular space between the housing 1 and the outer casing 7 and from the pump periphery flows between the lower and upper elements 34 and 35 on the horizontal plane in the inter-rib space between the radial outer ribs 36 of a thickened, streamlined form from the inlet flow side in the transverse section, and the closer to the pump axis between the flat inner ribs 37 that are mated to it, together forming radial sector flows 38 in the cross-section of the pump. Radial sector flows 38 merge in the upper annular radial-axial flow in the confuser 39 with flat radial ribs 37 and 41, which act as an extension of the flat inner ribs 37. The flow passes through the upper confuser 39 and there smoothly turns from the horizontal to the downward axial direction using blades 55 completely similar to the flow in the lower confuser 19 within the diameter of the location of point 22. Pump fluid flows passes through the upper and lower rims 3 and 4 of the impeller 2 and merge after into a single annual flow, which rotates as it enters into the annular outlet 6 and further along it moves along the annular guide vanes 5. After the guide vane 5 the blades 17 and 58 turn the flow, smoothly and without separating from the blade surfaces, in the axial direction and flows smoothly from above onto the inclined pipes 15 along them forming without vortex formation and transverse intersections the forming pipes 15 with minimal hydraulic resistance. The flow appears in the pocket-cavities 18, formed by the blades 17, located from the guiding vane 5 until pipes 15 and from the inner casing 8 until the outer casing 7. Further along the flow smoothly exits the pocket-cavities 18 in the axial direction between pipes 15 with minimal hydraulic losses and then gradually runs into the pressure pipe 10.

Thus, the claimed invention attains the achievement of all stated goals, specifically:

1. To reduce the outer diameter of the pump by placing an annular guide vane between the annular outlet and the collector, i.e. join the annular outlet and annular guiding vane into a single annular section under each other. The intersection of the annular outlet with the radial-axial inlet flow to the lower rim to the lower rim is not on the flat annular cross-section but along the lateral surface of the truncated cone, forming the pipe axes. This permits the preservation of the original outer diameter of the pump. Installing blades with curved surfaces after the annular guiding vane smoothly turns the annular flow, exiting the guiding vanes in the axial direction and further allowing the smooth move the flow from the axial into the radial direction between the inclined pipes. At the same time the necessary, effective flow section between pipes is achieved by increasing the outer radius of the elliptical bottom, while ensuring the uninterrupted current flow along the blades with curved surfaces of a specified radius of curvature. Also, in order to achieve a high efficiency additional blades may be installed to provide uninterrupted current flow along the blades. This way, increasing the area of the passage section between pipes by extending the pump does not influence the outer diameter of the pump and is not critical for the pump length due to its application in integral-type reactors. Moreover, using corrugated casing as a annular baffle, where adjacent cavities jointly form an effective outer annular inlet on the upper rim between the housing and corrugated casing, allows a decrease in the diameter of the pump housing due to the additional flow section, formed together by adjacent cavities, compared to an annular baffled implemented as a casing with flange. Therefore, the minor complication of the annular baffle in the form of corrugated casing permits the decrease in pump housing diameter, which is a priority for the pump when arranging it in the reactor housing.

2. To simplify pump design. Complex inlet forms, made by casting, are replaced by a simple inlet to the upper rim, implemented as two annular elements, connected to each other by radial rib using welding and providing a flow inlet from the annular spaces uniformly along the whole perimeter of the pump. The inlet to the lower rim is in the form of cylindrical or conical pipes, connected to the bottoms by welding. Intersections of the pipes with concentric bottoms, whose axes pass through their common center, forming a circumference, which allows you to achieve the correct weld geometry. The rest of the pump's flow parts are designed using forgings and sheet casings. The upper and lower annular radial-axial confusers may be manufactured either by forging with mechanical processing or by stamping from a sheet and machined afterwards. The inner part of the upper annular confuser with flat radial ribs is removable with the largest possible diameter, for example, together with the lower radial bearing. Furthermore, the upper annular radial-axial confuser with inner and outer parts, with flat radial ribs, as a single assembly, may be removable and mounted on the flange of the lower annular element along its inner diameter. This allows a significant simplification of the design of the inlet to the upper rim, achievement of freer access to it during manufacturing and product quality improvement. The lower annular confuser's inner and outer parts with flat radial rips, as a single assembly, are jointly disassembled and mounted to the flange on the inner casing, which significantly simplifies the manufacture of the confuser and its non-removable peripheral zone. Simplification of pump construction permits increasing the quality of the manufacturing process, lowering the size and mass dimensions of the pump and decreasing the production cost.

3. Increase pump efficiency. Increasing pump efficiency is achieved by lowering hydraulic resistance to the inlet flow to the upper rim by use of the entire perimeter of the outer annular inlet, and to the lower rim by turning the channel in the form of pipes from a horizontal position to an axial one with slightly inclined axes of pipes to the center bottom and passing through it. Lowering the hydraulic resistance of the oulet flow after the guide vanes is achieved by an arrangement of blades with curved surfaces that smoothly turn the flow, without separation from the blade surfaces, from the guide vanes to the axial direction and smoothly direct it from the top to the inclined pipes along the formation, forming pipe surfaces without transverse intersections and therefore without vortex formation, with minimal hydraulic resistance and subsequent passage between them into the pressure pipe. The improved outlet after the guiding vanes and inlet to the upper and lower rim with reduced hydraulic resistance together with the upper and lower annular confuser with ribs and blades between them equalize the velocity field at the impeller inlet, providing geometric similarity of the inlet to the rims and eliminating the effect of the rotating shaft on the incoming radial-axial flow, thus ensuring dynamic similarity, equalizing the work of the upper and lower rims, and achieving a higher pump efficiency.

4. Improvement of anti-cavitation properties and service life of the pump. A simple comparison of the pump produced by the claimed invention with the prototype, having the same outer pump diameters and providing one and the same key pump features, namely, the delivery rates, leads to the following conclusions:

a. Placement of the annular guide vanes between the annular outlet and collector while preserving the intersection of the discharge and supply flows in the diametric annular section, as that of the prototype, permits the accommodation of an impeller with a greater diameter, the creation of a pump with Coe≈0.62 and a reduction in impeller speed by about 25%;

b. The transfer of the intersecting flows from the flat annular section (as in the prototype) to the lateral surface of the truncated cone (as in the claimed invention) allows the creation of a pump with Coe≈0.8 and additionally lower the impeller's rotation speed by approximately another 25%.

c. According to the Rudnev S. S. formula $\Delta hmax=10((n\sqrt{Q})/Csc)4/3$, where $\Delta hmax.$=the maximum pressure drop on the impeller intake;

n=rotational speed of pump impeller;

Q=supply; and

Csc=cavitation speed coefficient, lowering the impeller rotation speed decreases the magnitude of the maximum pressure drop at impeller suction and the relative velocity of the flow at the inlet to the impeller and thereby increases the anti-cavitation properties and service life of the pump.

d. Thus, the claimed invention makes it possible to create a pump with high efficiency Coe≈0.8, significantly exceeding the prototype parameter Coe≈0.47, and position within it an impeller of a larger diameter, lower the impeller rotation speed, and lower the drop in pressure at the impeller inlet and, consequently, increase the anti-cavitation properties and service life of the pump;

5. Improve the inlet flows and reduce their effect on each other. The separation of axial annular inlet flows into a concentric inner and outer yields a reduction in the effects of jet flows and eliminates the effects of the sides on one another, unlike the prototype, where the inlet is created using one annular section between the housing and outer casing. Placement of the annular baffle between the pump housing and outer casing allows an additional decrease in jet flow influence on each other in the form of vortices that pass into the pump inlet and degrade the velocity field. Improvement of the inlet flows to the upper rim, formed by two annular elements and connected together by radial ribs, by the arrangement of inlets from the whole perimeter of the outer casing and to the lower rim, by the channel turns, in the form of pipes, from the horizontal plane into the axial direction, has significantly reduced the hydraulic resistance on pump suction. Use of upper and lower annular radial-axial confusers in the pump eliminates the effect of the rotating shaft on the incoming radial-axial flow, provides geometric similarity of incoming flows to the upper and lower rims, ensures their dynamic similarity, equalizers the velocity field of the working rims using blades with curved surfaces, mounted on ribs, and achieve the closest possible balance of the rims' workload.

The description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalents.

What is claimed is:

1. A vertical centrifugal pump, comprising: a cylindrical housing, a dual inlet impeller with upper and lower bladed rows, annular guiding vanes, an annular outlet with outer and inner casings, forming a collector below with a pressure pipe, and inlet flow channels to lower and upper rims, the last of which is formed by said housing and said outer casing, wherein said annular guiding vanes are positioned between said annular outlet and collector, said outer and inner casings are in a form of two elliptical, concentric bottoms, an outer bottom and an inner bottom, positioned along an axis of the pump, said inlet flow channels to lower rims pass through said bottoms via pipes, whose axis runs through a center of said bottoms, from said annular guiding vanes to said pipes, wherein blades with curved surfaces are placed from said inner casing to said outer casing, said blades forming pocket-cavities with a radial flow outlet between said pipes into a pressure pipe, with a steady flow stream along blades of a specific radius of curvature, wherein said pipes are connected to said lower rim through a lower annular radial-axial confuser with flat ribs, mounted radially between said pipes, wherein said confuser's internal part of profile is located from a line of intersection of internals forming a pipe, inner part of profile and outer bottom, and an outer part, positioned on a horizontal plane, from said inner casing with a smooth turn into an axial direction to a lower bladed rim, wherein an annular baffle exists between said housing and outer casing, said annular baffle comprising a corrugated casing with a minimal mounting gap on an upper end relative to said outer casing, mounted on said housing by radial ribs on upper and lower ends, wherein said radial ribs' projections form, across from said pipes, longitudinal inlet flow channels to a lower rim together with an inner annular inlet between said corrugated casing and said pressure pipe, and wherein adjacent cavities together form an outer annular inlet to an upper rim between said housing and said corrugated casing, whose lower end is located below a lowest point of said pipes, and wherein inlet flow channels to an upper rim are made between two annular elements, a lower element and an upper element, with horizontal surfaces, interconnected by radial outer ribs with a thickened, streamlined form and mated with flat inner ribs, together forming radial sectors in a transverse section of the pump, merged with an upper annular radial-axial confuser along an inner diameter of said annular elements, equal to a diameter of the position of a point of intersection of internals forming said pipe, inner parts of a profile of a lower confuser and an inner bottom, with flat radial ribs, which are a continuation of said flat inner ribs, having a smooth turn of a flow in an axial direction, which is positioned up to an upper bladed rim similar to the lower confuser.

2. The pump according to claim 1, wherein said annular baffle is a casing with a flange along the inner diameter on said baffle's upper end and a minimal mounting gap exists between the flange and the outer casing, fixed to the housing radial ribs, on its upper and lower ends, the lower end being positioned below the lowest point of the pipes, which divides the axial annular inlet between the housing and pressure pipe on the inner annular inlet to the lower rim and the outer annular inlet to the upper rim.

3. The pump according to claim 1, wherein an inner part of the upper annular radial-axial confuser with flat radial ribs is removable along the largest possible diameter, together with a lower radial bearing and mounted to it at its end, while a lower confuser's inner and outer parts with flat radial ribs, as a single system, is disassembled and affixed to a flange on the inner casing, whereby an outer part of the upper confuser is removable and in a form of a flange, forming an outer part of an upper confuser profile.

4. The pump according to claim 1, wherein the upper annular radial-axial confuser with its inner and outer parts and flat radial ribs, is implemented as a single assembly and mounted on a flange of a lower annular element along its inside diameter.

5. The pump according to claim 1, wherein between radially installed ribs of an outer part of the lower confuser, blades are located and mounted to said ribs, the blades being of a constant thickness with a curved surface, concentrically arranged between themselves along the pump axis, uniformly along a meridian section, with a thickness of projections onto a horizontal plane equal to a projection of a pipe diameter on the same plane, where, from a side of inlet edges, the blades have a smooth decrease in thickness in the direction of the edge.

6. The pump according to claim 1, wherein the upper and lower confusers with flat radially-mounted ribs, having geometrically similar parts, have blades of a constant thickness along a section, with a curved surface, concentric to an inner part of each confuser, mounted on ribs uniformly along a meridian section of each confuser, wherein a flow can be changed from a horizontal direction to an axial direction towards the corresponding rim, while from sides of outlet edges the blades have a smooth decrease in thickness in a direction of the corresponding edge, and from the inlet flow side the blades of the upper confuser have a smooth decrease in thickness in the direction of the corresponding edge.

7. The pump according to claim 1, wherein radial ribs of the upper confuser are rotated by a half pitch between them in relation to radial flat ribs of the lower confuser.

8. The pump according to claim 1, wherein radial flat ribs have a smooth decrease in thickness in a direction of an impeller rim.

9. The pump according to claim 1, wherein pipes at an inlet have confusers.

10. The pump according to claim 1, further comprising additional blades between pipes.

11. The pump according to claim 1, wherein all blades between guiding vanes and pipes have a constant thickness and, from an incoming side of a flow, are streamlined with a gradually reduced thickness at a front edge.

12. The pump according to claim 1, wherein a lower part of an annular baffle wall has reduced thickness along its whole perimeter.

* * * * *